US008011356B2

(12) United States Patent
Gordon et al.

(10) Patent No.: US 8,011,356 B2
(45) Date of Patent: Sep. 6, 2011

(54) BOWSTRING DAMPENER

(75) Inventors: Sean Gordon, Evansville, IN (US); Ben Blosser, Richland, IN (US)

(73) Assignee: Bear Archery, Inc., Evansville, IN (US)

( * ) Notice: Subject to any disclaimer, the term of this patent is extended or adjusted under 35 U.S.C. 154(b) by 419 days.

(21) Appl. No.: 12/208,796

(22) Filed: Sep. 11, 2008

(65) Prior Publication Data

US 2009/0071458 A1 Mar. 19, 2009

Related U.S. Application Data

(60) Provisional application No. 60/972,406, filed on Sep. 14, 2007.

(51) Int. Cl.
*F41B 5/20* (2006.01)

(52) U.S. Cl. ..... 124/88; 124/25.6; 124/86; 124/89; 124/92; 267/136; 267/139

(58) Field of Classification Search ..... 124/25.6, 124/86, 88, 89, 92; 267/136, 139
See application file for complete search history.

(56) References Cited

U.S. PATENT DOCUMENTS 2,474,723 A * 6/1949 Boose ..... 273/129 R
2,709,938 A * 6/1955 Schmid ..... 72/479
2,765,827 A * 10/1956 Hall ..... 81/21
2,777,347 A * 1/1957 Sendoykas ..... 81/379
2,906,150 A * 9/1959 Stewart ..... 72/466.6
3,037,219 A * 6/1962 Webb ..... 416/72
3,342,172 A 9/1967 Sanders
3,446,200 A * 5/1969 Gross ..... 124/24.1
3,502,062 A 3/1970 Shurts
3,545,789 A * 12/1970 Graham ..... 280/753
3,808,870 A * 5/1974 Blancett ..... 72/413
3,923,036 A 12/1975 Jennings et al.
3,971,244 A * 7/1976 Zengerer ..... 72/395
4,061,125 A * 12/1977 Trotter ..... 124/23.1
4,071,014 A 1/1978 Trotter
4,200,130 A * 4/1980 Reamy ..... 81/20
D257,619 S 12/1980 Eastman, II et al.
4,252,318 A * 2/1981 Thibodeau ..... 273/129 L
4,452,222 A 6/1984 Quartino et al.
4,461,267 A * 7/1984 Simonds et al. ..... 124/25.6
4,628,892 A * 12/1986 Windedahl et al. ..... 124/25.6
(Continued)

OTHER PUBLICATIONS

Double STS Archery System [online] http://www.stsarchery.com/double.htm [retrieved on Dec. 12, 2006].

(Continued)

*Primary Examiner* — Gene Kim
*Assistant Examiner* — Alexander R Niconovich
(74) *Attorney, Agent, or Firm* — Woodard, Emhardt, Moriarty, McNett & Henry LLP

(57) ABSTRACT

An archery bow comprises an archery bow body defining opposing limb tips and a bowstring extending between the limb tips. The archery bow includes an elongate member extending from the bow body, the elongate member having a length and a proximal end arranged adjacent the bowstring. Additionally, the archery bow includes a dampening element made of a vibration dampening material mounted to the proximal end between the proximal end and the bowstring, the dampening element having a contact face adapted to contact the bowstring. In certain embodiments, the dampening element includes a laterally protruding rib extending outward from the contact face along at least a portion thereof to engage the bowstring when the bowstring is released.

20 Claims, 5 Drawing Sheets

U.S. PATENT DOCUMENTS

| | | | | |
|---|---|---|---|---|
| 4,817,579 | A | 4/1989 | Mathias | |
| 4,834,061 | A | 5/1989 | Chattin | |
| 4,905,988 | A * | 3/1990 | Mooneyhan | 482/50 |
| 5,119,699 | A * | 6/1992 | McBride et al. | 81/25 |
| 5,146,908 | A * | 9/1992 | Larson | 124/88 |
| 5,178,122 | A | 1/1993 | Simonds | |
| 5,323,756 | A * | 6/1994 | Rabska | 124/86 |
| 5,372,119 | A | 12/1994 | Kidney | |
| 5,373,831 | A | 12/1994 | Cushman | |
| 5,415,149 | A | 5/1995 | Derus et al. | |
| 5,425,351 | A * | 6/1995 | Kozitka | 124/88 |
| 5,452,704 | A * | 9/1995 | Winebarger | 124/92 |
| 5,590,868 | A * | 1/1997 | Hebert et al. | 254/26 R |
| 5,630,407 | A | 5/1997 | Gasser | |
| 5,682,871 | A | 11/1997 | Walk et al. | |
| 5,720,269 | A * | 2/1998 | Saunders | 124/86 |
| 5,762,060 | A | 6/1998 | Larson | |
| 6,176,156 | B1 * | 1/2001 | Coonrad | 81/20 |
| 6,237,584 | B1 * | 5/2001 | Sims | 124/92 |
| 6,363,817 | B1 * | 4/2002 | Lamond et al. | 81/22 |
| 6,425,385 | B1 | 7/2002 | Gallops, Jr. | |
| 6,430,775 | B1 * | 8/2002 | Bushey | 16/86 A |
| 6,499,478 | B1 * | 12/2002 | Perez | 124/86 |
| 6,532,945 | B1 | 3/2003 | Chattin | |
| 6,550,467 | B2 * | 4/2003 | Gallops, Jr. | 124/25.6 |
| 6,634,348 | B2 * | 10/2003 | Gallops, Jr. | 124/25.6 |
| 6,708,684 | B2 | 3/2004 | Chattin | |
| 6,715,479 | B1 * | 4/2004 | Bunk | 124/25.6 |
| 6,904,900 | B2 | 6/2005 | Gallops | |
| 6,925,721 | B2 | 8/2005 | Dietz | |
| 6,966,314 | B2 * | 11/2005 | McPherson | 124/89 |
| 6,976,484 | B1 | 12/2005 | Gallops | |
| 7,174,809 | B1 * | 2/2007 | Schipul | 81/20 |
| 7,213,590 | B2 | 5/2007 | Pellerite | |
| 7,311,098 | B2 * | 12/2007 | Gallops, Jr. | 124/25.6 |
| 7,721,724 | B2 * | 5/2010 | Goade | 124/89 |
| 7,753,044 | B2 | 7/2010 | Goade | |
| 7,793,646 | B2 * | 9/2010 | Cooper et al. | 124/89 |
| 2002/0104526 | A1 | 8/2002 | Chipman | |
| 2003/0056779 | A1 * | 3/2003 | Gallops, Jr. | 124/89 |
| 2003/0056780 | A1 * | 3/2003 | Gallops, Jr. | 124/92 |
| 2003/0136392 | A1 * | 7/2003 | McPherson | 124/25.6 |
| 2003/0178017 | A1 | 9/2003 | Chattin | |
| 2004/0134473 | A1 | 7/2004 | Gallops | |
| 2005/0268892 | A1 | 12/2005 | Gallops | |
| 2006/0180135 | A1 | 8/2006 | Andrews | |
| 2006/0278207 | A1 | 12/2006 | Goade | |
| 2006/0283435 | A1 | 12/2006 | Pellerite | |
| 2008/0163729 | A1 * | 7/2008 | Stevens | 81/319 |
| 2008/0236559 | A1 * | 10/2008 | Barnard | 124/89 |
| 2008/0264400 | A1 * | 10/2008 | Wright | 124/89 |
| 2009/0000606 | A1 | 1/2009 | Cooper et al. | |
| 2009/0071457 | A1 * | 3/2009 | Gordon et al. | 124/25.6 |
| 2009/0071458 | A1 * | 3/2009 | Gordon et al. | 124/25.6 |
| 2009/0133683 | A1 * | 5/2009 | Wright | 124/89 |
| 2010/0089375 | A1 * | 4/2010 | McPherson et al. | 124/25.6 |
| 2010/0095943 | A1 | 4/2010 | Cooper | |
| 2010/0192931 | A1 | 8/2010 | Brewster | |
| 2010/0224178 | A1 * | 9/2010 | McPherson | 124/25.6 |

OTHER PUBLICATIONS

EDS System [online] http://www.stsarchery.com/eds.htm [retrieved on Dec. 12, 2006].

Stealthshot String Suppression System advertisements from HOYT 2007 Catalog [pp. 2&3 of the Catalog].

Three Pictures of Delta V Archery Bows sold by Bear Archery in the 1980's.

* cited by examiner

BOWSTRING DAMPENER

CROSS-REFERENCE TO RELATED APPLICATIONS

This application claims the benefit of U.S. Provisional Application Ser. No. 60/972,406, filed Sep. 14, 2007 which is hereby incorporated by reference in its entirety.

FIELD OF THE INVENTION

The present invention relates generally to archery bows and more particularly pertains to a bowstring vibration dampener for use with and mounted to archery bows.

BACKGROUND OF THE INVENTION

An archery bow stores energy when an archer draws the bowstring. When the bowstring is released, the stored energy propels the arrow. In conventional bows, the bowstring continues to vibrate or oscillate after release until it settles to a stable state. This vibration can be transmitted to the archer, making the bow difficult to handle and aim accurately and/or can cause undesired sound which could alert target game.

In certain arrangements, vibration dampeners are mounted to a bow to reduce vibrations; however, an improved vibration dampener is desired.

Objects and attendant advantages of this invention will be readily appreciated as the same become more clearly understood by references to the following detailed description when considered in connection with the accompanying drawings in which like reference numerals designate like parts throughout the figures thereof.

SUMMARY OF THE INVENTION

In certain embodiments, an archery bow comprises an archery bow body defining opposing limb tips and a bowstring extending between the limb tips. The archery bow includes an elongate member extending from the bow body, the elongate member having a length and a proximal end arranged adjacent the bowstring. Additionally, the archery bow includes a dampening element made of a vibration dampening material mounted to the proximal end between the proximal end and the bowstring, the dampening element having a contact face adapted to contact the bowstring. The dampening element includes a laterally protruding rib extending outward from the contact face along at least a portion thereof to engage the bowstring when the bowstring is released.

In certain other embodiments, a dampener for an archery bow comprises an elongate member having a length and defining a distal end and a proximal end. The distal end of the elongate member is attachable to the body of an archery bow having a bowstring. Additionally, the proximal end of the elongate member is arrangeable adjacent the bowstring. The dampener includes a dampening element made of a vibration dampening material mounted to the proximal end to be arranged between the proximal end and the bowstring. The dampening element includes a curved contact face opening toward the bowstring and having a laterally protruding rib facing the bowstring.

In further embodiments, a dampening element for an archery bow comprises a dampening element made of a vibration dampening material and having a proximal end mountable to an archery bow and a distal end arrangeable adjacent an archery bowstring. The dampening element has a contact face at the distal end adapted to contact an archery bowstring. Additionally, the contact face has a non-flat vertical profile facing the bowstring when the dampening element is mounted to an archery bow. The non-flat vertical profile defines an initial bowstring contact point and a plurality of subsequent bowstring contact points during forward oscillation of the bowstring after release, wherein the initial bowstring contact point is positioned closer to the bowstring than the subsequent bowstring contact points when the dampening element is mounted to the archery bow and the bowstring is at rest.

DESCRIPTION OF THE ILLUSTRATED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Figure 1:
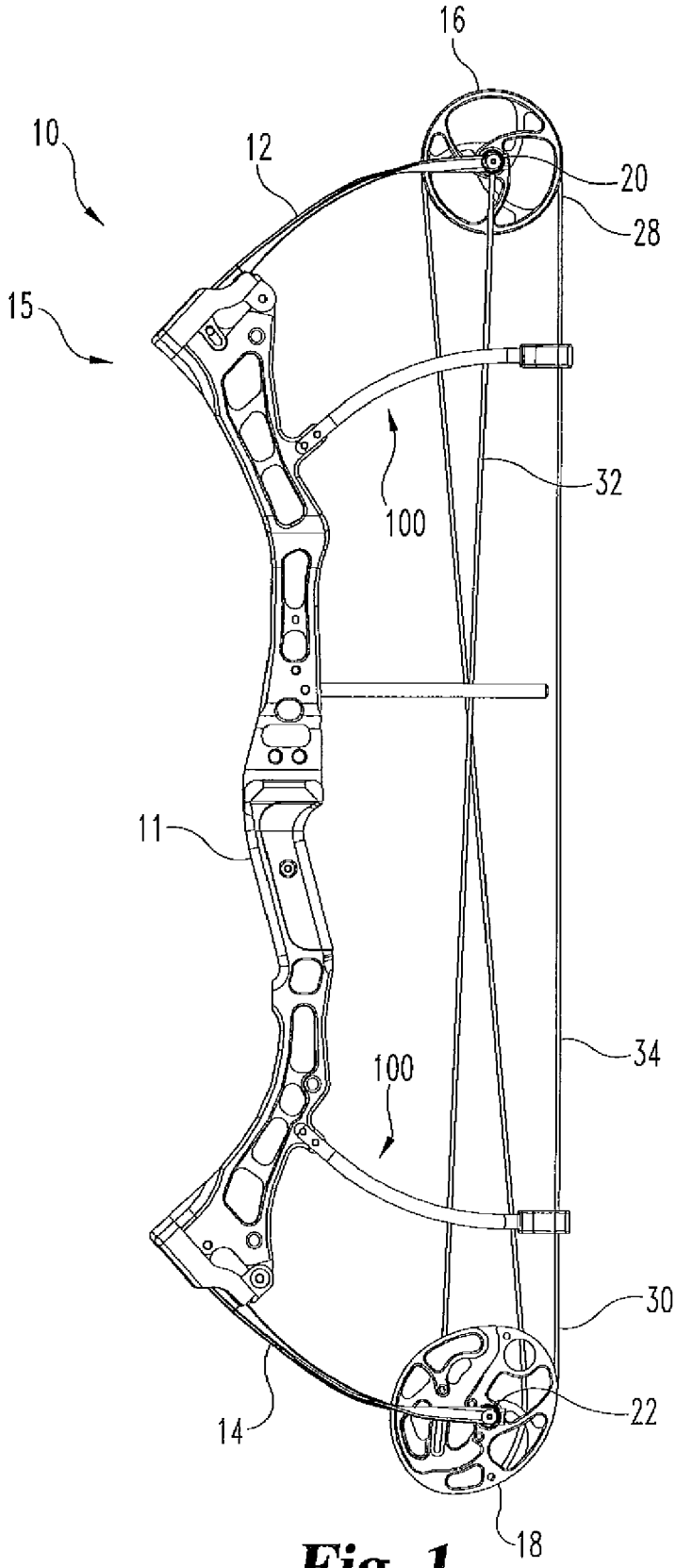
FIG. 1 is a perspective view of a bow incorporating a dampener according to a preferred embodiment of the present invention.

FIG. 1 illustrates one example of a conventional single cam compound archery bow generally designated as 10. When viewed from the perspective of an archer holding the bow 10, it includes a riser 11 with a handle, an upper limb portion 12 and a lower limb portion 14. Rotational members forming one or two variable leverage units such as idler wheel 16 and eccentric cam 18 are supported at the limb tip sections for rotary movement about axles 20 and 22. In the embodiment shown, upper and lower limbs are formed of parallel and symmetric limb portions sometimes called quad limbs. Idler wheel 16 is carried between the outer limb tip portions of upper limb 12. The lower pulley axle 22 is carried between the outer limb tip portions of lower limb 14.

Bowstring 34 includes upper end 28 and lower end 30 which are fed-out from idler wheel 16 and cam 18 when the bow is drawn. Bowstring 34 is mounted around idler wheel 16 and cam 18 as is known in the art. Additionally, a y-yoke anchor cable 32 extends from cam 18 up to axle 20 of wheel 16. From the perspective of the archer, the bowstring is considered rearward relative to the riser which defines forward.

When the bowstring 34 is drawn, it causes idler wheel 16 and cam 18 at each end of the bow to rotate, feeding out cable and bending limb portions 12 and 14 inward, causing energy to be stored therein. When the bowstring 34 is released with an arrow engaged to the bowstring, the limb portions 12 and 14 return to their rest position, causing idler wheel 16 and cam 18 to rotate in the opposite direction, to take up the bowstring 34 and launch the arrow with an amount of energy proportional to the energy initially stored in the bow limbs.

Bow 10 is described for illustration and context and is not intended to be limiting. In addition to single-cam bows, the present invention can also be used with dual-cam compound bows. It can also be used with hybrid cam bows, recurve bows and/or quad limb bows. The present invention can also be used in other types of bows, which are considered conventional for purposes of the present invention. For discussion purposes, the combination of riser 11, limb 12 and limb 14 will generally be referred to as archery bow body 15. Accordingly, it should be appreciated that the archery bow body can take on various designs in accordance with the many different types of bows with which the present invention can be used.

FIGS. 1-5 illustrate a vibration dampener and a bow according to embodiments of the present invention. Bow 10, illustrated in FIG. 1, includes two vibration dampeners 100 mounted to upper and lower portions of a riser 11 of bow body 15. Upper and lower vibration dampeners 100 are preferably mirror images, so an upper vibration dampener will be discussed in detail for convenience; however, the description is applicable to the lower vibration dampener as well. Alternately, only one or more than one vibration dampener can be mounted to riser at the top, bottom and/or middle of the riser.

Figure 2:
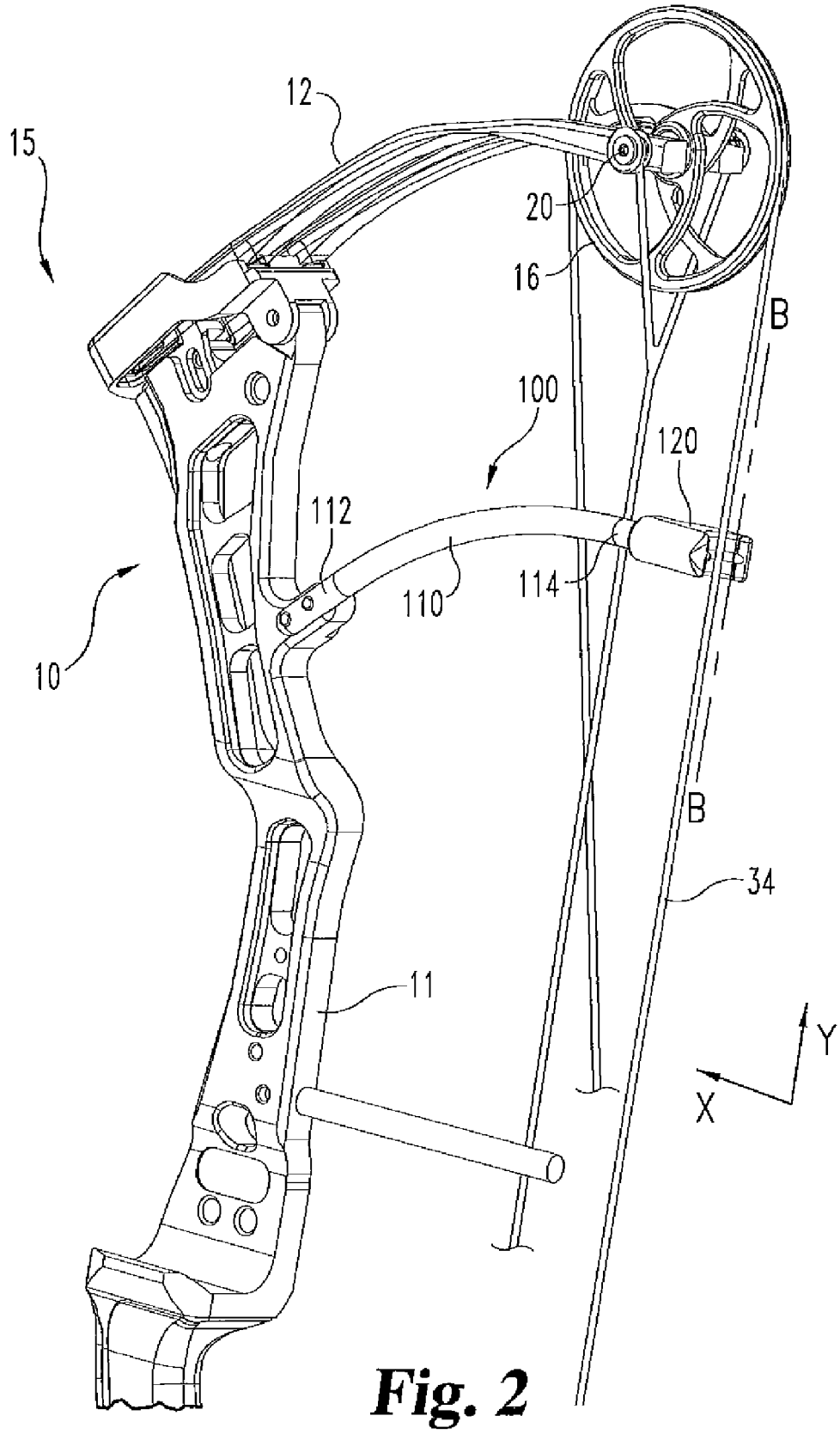
FIG. 2 is an enlarged perspective view of a portion of the bow and a dampener of FIG. 1.

FIG. 2 illustrates an enlarged view of dampener 100 mounted to bow 10. In the embodiment illustrated, dampener 100 includes an elongate member or rod 110 extending from a distal end 112 mounted to riser 11 to a proximal end 114. A dampening element 120 is mounted to proximal end 114 and is arranged between proximal end 114 and bowstring 34 when the bowstring is in an at-rest position. Preferably, dampening member 120 is arranged to intersect bowstring 34 substantially perpendicular to axis B of the bowstring.

Figure 3:
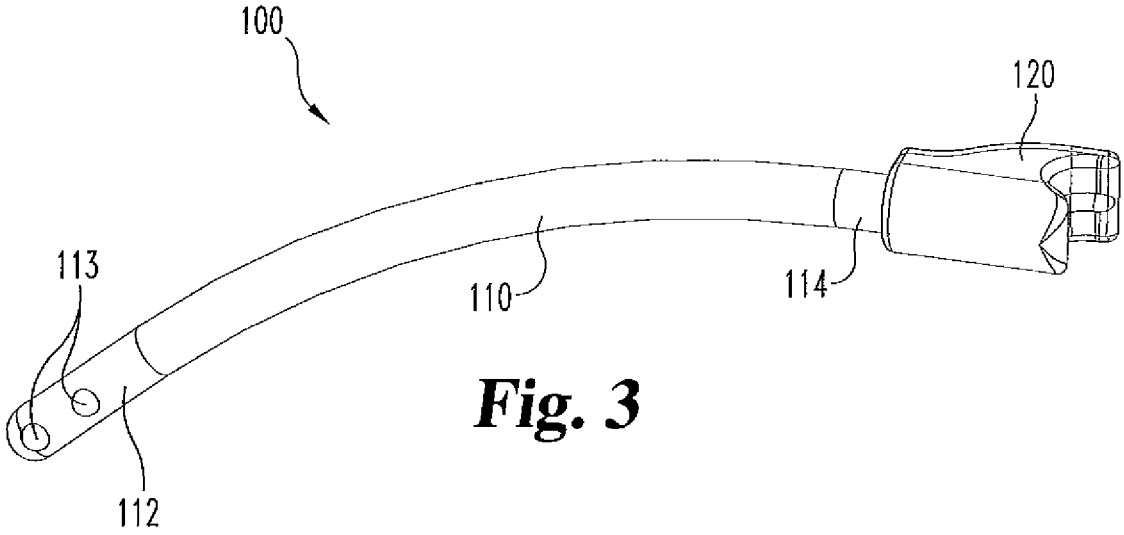
FIG. 3 is a perspective view of a dampener of FIG. 1.

FIG. 3 illustrates a view of one example embodiment of dampener 100. In the illustrated embodiment, dampener 100 is shown with a curved bar or rod 1I O, although alternative embodiments include a straight rod or a straight or curved tube. Bar or rod 110 may be formed of metal such as steel or aluminum, or alternately, may be made of a material with sufficient strength and rigidity such as a composite rod. The rod may optionally be solid or hollow as desired.

In the illustrated embodiment, rod 110 is mounted to riser 11 at distal end 112 at an angled arrangement with respect to the riser. Additionally, as illustrated the elongate rod 110 may define one or more bores 113 through which fasteners can be inserted such that the fasteners extend into or through riser 11 (see FIG. 3). As an example, cap head screws may be used to mount the rod 110 to the archery bow body 15. Other example mounting arrangements include screwing or attaching the rod directly into a rearward facing opening in the riser, having a molded in place rod extending from the riser, fastening the rod to a side of the riser, using a clamping mechanism to attach the rod to the front, rear or a side of the riser, welding the rod to the riser, or using an adhesive to mount the rod. As an alternative, rod 110 may be integral with riser 11 as a one-piece construction extending from the riser, where a portion of the bar is cast, forged, molded or machined to extend from a riser section. In certain embodiments, the rod mounting may be adjustable to extend or retract the vibration dampener with respect to the riser to adjust its position relative to the bowstring.

Figure 4:
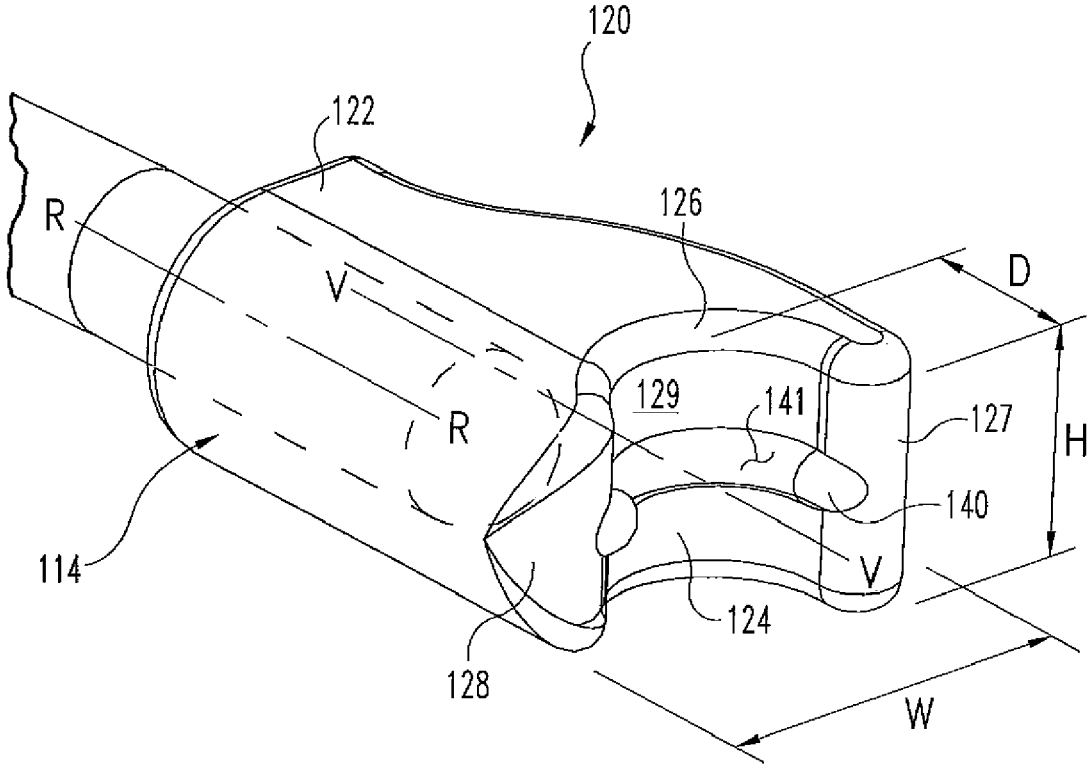
FIG. 4 is a perspective view of a dampening element of the dampener of FIG. 3.
Figure 5:
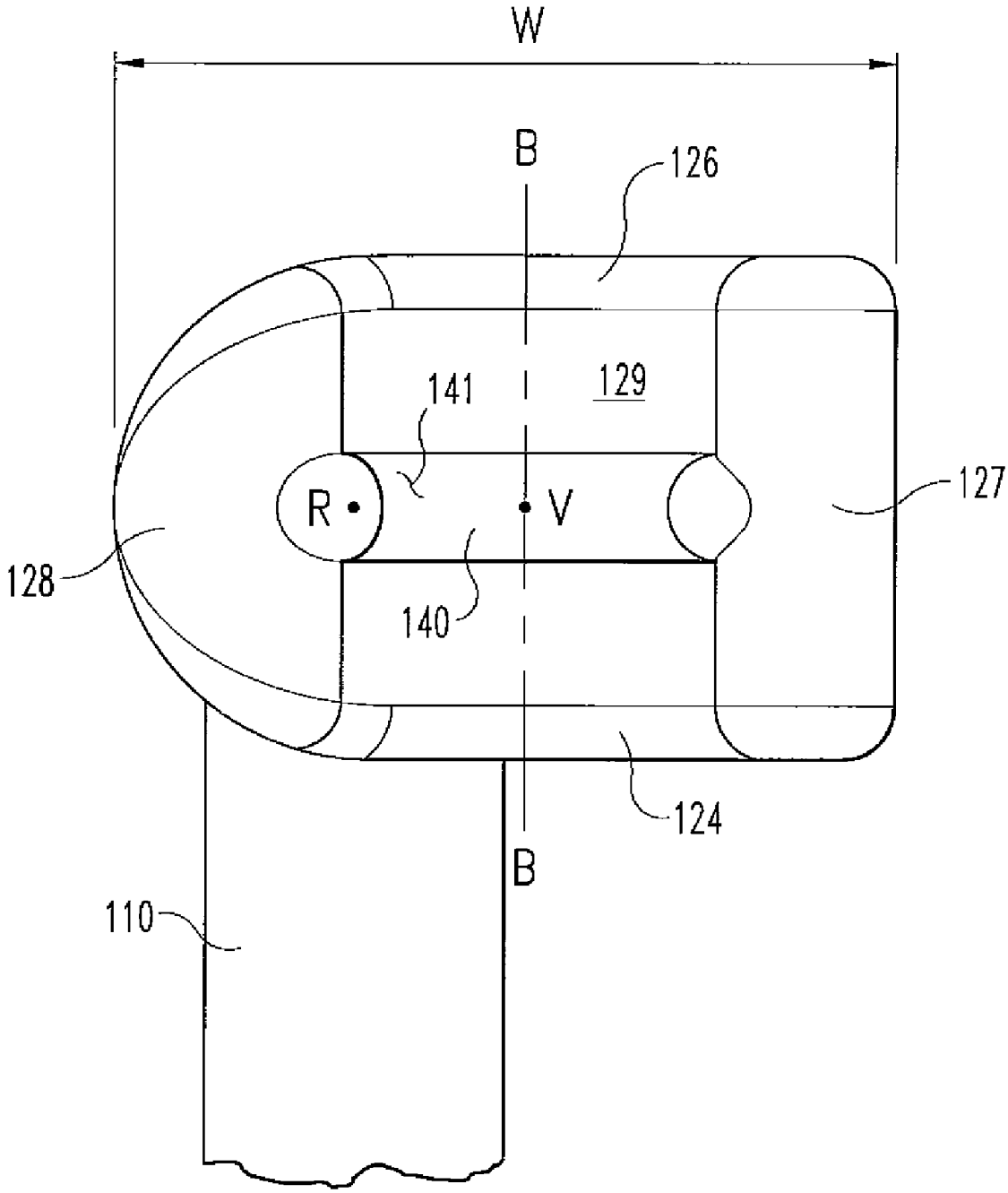
FIG. 5 is a front view of a dampening element of the dampener of FIG. 3.

FIGS. 4 and 5 illustrate perspective and rearward views of dampening element 120 mounted to rod 110. As illustrated, for example in FIG. 4, dampening element 120 is mounted to the proximal end 114 of elongate rod 110. Dampening element 120 includes a distal end 122 which receives proximal end 114 of the rod and a proximal end 124 arranged to engage bowstring 34. Dampening element 120 defines a vibration axis V through the centerline of the dampening element and arranged to perpendicularly intersect bowstring axis B. Vibration axis V is parallel to a rod axis R of rod 110 arranged through proximal end 114. Vibration axis V may be aligned with rod axis R, although as illustrated, axis V may be offset laterally from axis R.

In certain embodiments, the proximal end 124 of the dampening element 120 defines a curved contact face 126 with a substantially open profile as illustrated, the face being curved along at least a portion of the width W thereof. Example profiles include "U," "v" or "C" shaped profiles, taken as cross-sections of the contact face parallel with vibration axis V and/or along a plane perpendicular to the bowstring. An alternate profile is a keyhole "C" type with a narrow entrance into a wider central area. Contact face 126 preferably includes an outward side 127 and an inward side 128 connected by an inset central face portion 129, such that sides 127 and 128 and portion 129 generally define the curve of the contact face. The central face portion 129 is preferably perpendicular to bowstring 34 with an upper side and lower side spaced along the bowstring. Additionally, as illustrated, face 126 generally opens in a direction toward and perpendicular to the bowstring. Face 126 is preferably defined by a width W between opposing sides 127 and 128, a depth D measured from the outermost point of the profile of the face to the innermost point in a direction parallel to vibration axis V, and a height H perpendicular to axis V.

In certain embodiments, the shaped profile of face 126 accepts the bowstring between the sides when at rest and during oscillation of the bowstring. Width W is preferably sufficiently wide to capture the bowstring during oscillation within an expected range of lateral movement of the bowstring upon release or rebound. In use, when the bowstring is in oscillation, a forward oscillation of the bowstring will travel between the sides to impact central portion 129, imparting energy and dampening the vibration during the impact. In certain embodiments, sides 127 and 128 flex inward upon the impact of the bowstring on central portion 129. This inward motion of sides 127 and 128 narrows the width of the profile of the face. The narrowed profile minimizes the lateral rebound ability of the bowstring and in preferred cases the sides may partially pinch or close behind the bowstring to inhibit and minimize rearward oscillation of the bowstring by capturing it between the sides.

In a separate optional, yet preferred, feature, proximal end 124 includes a non-flat vertical profile along contact face 126 to better distribute the impact of forward oscillation of the bowstring 34. The non-flat vertical profile may be created by an irregular profiled surface of the contact face and/or the addition of a rib or other such similar protrusion to the contact face. As an example, in the illustrated embodiment proximal end 124 includes a central rib 140 extending laterally across face 126 along at least a portion of width W, such that the rib extends horizontally when the bow is held upright by a user. As illustrated, rib 140 is a protruding section midway along the height H of the face 126 and curves along with the open, curved profile of face 126. In this configuration, the central portion of rib 140 is the initial point of contact for forward oscillation of bowstring 34. This initial point begins the absorption of energy and spreads the contact of the bowstring over time as it impacts central portion 129 to increase the points of contact at subsequent contact points gradually instead of simultaneous contact along the entire height H of the dampening element 120. As illustrated, the outer sides of rib 140 may extend slightly inward from sides 127 and 128 of the dampening element.

In certain embodiments, rib 140 includes a round, curved or arcuate contact surface 141 such that the rib protrudes convexly from the contact face. Rib 140 has a width and a height aligned with the width W and height H of face 126, respectively. As illustrated, contact surface 141 may be curved along both the width and height of the rib 140. In a particular embodiment, surface 141 may be a half-circle along the height of rib 140 extending from face 126. In certain embodiments, rib 140 may include a profile or cross-sectional shape which matches the profile or cross-sectional shape of the contact face 126. Additionally, in some embodiments the cross-sections of the contact face and the rib taken along a plane perpendicular to the bowstring may be concentric. In alternative embodiments, rib 140 may include a contact surface having a shape or geometry other than rounded, curved or arcuate. As an example, the rib may be triangular in shape In one aspect, the rib 140 allows for adjustment of the vibration dampener 100 relative to the bowstring 34, for example as occurs during adjustment of the limbs, while helping to maintain a substantially close engagement between the dampener and the bowstring. In another aspect, the outer sides of the rib 140 reduce the ability of the bowstring to rebound laterally, and may also reduce or narrow the width of the profile more quickly when the outer sides of the face flex inwardly. In this arrangement, the outer sides of the rib 140 assist in capturing the bowstring to reduce rearward oscillation as well.

Dampening member 120 may be molded onto the proximal end of rod 114 or may be optionally separately mounted and replaceable. Dampening member 120 is preferably made from a resiliently compressible material capable of absorbing energy when impacted by the bowstring and preferably flexible to allow narrowing of the width of the profile during use. The dampening element 120 may be made from a material such as rubber, urethane or an open or closed cell foam material with the desired properties. In certain embodiments, the dampening element 120 may include voids therein or inner portions of differing heavier or lighter materials to adjust the vibration absorbing and flexibility characteristics of the dampening element.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An archery bow, comprising:

an archery bow body defining opposing limb tips;

a bowstring extending between said limb tips;

an elongate member extending from said bow body, wherein said elongate member has a length and a proximal end arranged adjacent said bowstring;

a dampening element made of a vibration dampening material mounted to said proximal end between said proximal end and said bowstring, said dampening element having a contact face adapted to contact said bowstring; and, wherein said dampening element includes a laterally protruding rib extending outward from said contact face along at least a portion thereof to engage said bowstring when said bowstring is released.

2. The bow of claim 1, wherein said bowstring extends along a bowstring axis and said dampening element extends along a vibration axis through the centerline of said dampening element, said vibration axis being perpendicular to said bowstring axis.

3. The bow of claim 1, wherein said elongate member extends along a rod axis at said proximal end and said dampening element extends along a vibration axis through the centerline of said dampening element, said vibration axis being parallel to and offset from said rod axis.

4. The bow of claim 1, wherein said rib protrudes convexly from said contact face.

5. The bow of claim 1, wherein said contact face includes a height and a width, and said protruding rib extends laterally across said face along at least a portion of said width midway along said height.

6. The bow of claim 1, wherein said contact face has a width and includes a curve at least partially along said width, said curve being defined by two side portions offset laterally from said bowstring when said bowstring is at rest and an inset middle portion, wherein said contact face opens toward said bowstring.

7. The bow of claim 6, wherein said side portions are adapted to flex toward each other when said bowstring contacts said middle portion upon release of said bowstring.

8. The bow of claim 6, wherein said dampening element has a centerline extending along a vibration axis perpendicular to said bowstring and said contact face has a cross-section along a plane perpendicular to said bowstring, said cross-section being selected from the group consisting of C-shaped, U-shaped, and v-shaped.

9. The bow of claim 8, wherein said rib has a cross-section along a plane perpendicular to said bowstring, said cross-section of said rib being concentric with said cross-section of said contact face.

10. A dampener for an archery bow, comprising:

an elongate member having a length and defining a distal end and a proximal end;

wherein said distal end of said elongate member is attachable to the body of an archery bow having a bowstring;

wherein said proximal end of said elongate member is arrangeable adjacent the bowstring;

a dampening element made of a vibration dampening material mounted to said proximal end to be arranged between said proximal end and the bowstring; and, wherein said dampening element includes a curved contact face opening toward said bowstring and having a laterally protruding rib facing said bowstring.

11. The dampener of claim 10, wherein the curve of said contact face is defined by two side portions offset laterally from said bowstring when said bowstring is at rest and an inset middle portion.

12. The dampener of claim 10, wherein said rib includes a curved contact surface protruding convexly from said contact face for contacting said bowstring.

13. The dampener of claim 10, wherein said dampening element has a centerline extending along a vibration axis perpendicular to said bowstring and said contact face has a cross-section along a plane perpendicular to said bowstring, said cross-section being selected from the group consisting of C-shaped, U-shaped and v-shaped.

14. The dampener of claim 13, wherein said rib has a cross-section along a plane perpendicular to said bowstring, said cross-section of said rib being concentric with said cross-section of said contact face.

15. The dampener of claim 10, wherein said contact face includes a height and a width, and said protruding rib extends laterally across said face along at least a portion of said width midway along said height.

16. A dampening element for an archery bow, comprising:

a dampening element made of a vibration dampening material and having a proximal end mountable to an archery bow and a distal end arrangeable adjacent an archery bowstring;

wherein said dampening element has a contact face at said distal end adapted to contact an archery bowstring, said contact face having a width; and, wherein said contact face has a non-flat vertical profile facing the bowstring when said dampening element is mounted to an archery bow, wherein said non-flat vertical profile defines an initial bowstring contact point and a plurality of subsequent bowstring contact points during forward oscillation of the bowstring after release, wherein said initial bowstring contact point is positioned closer to the bowstring than said subsequent bowstring contact points when said dampening element is mounted to the archery bow and the bowstring is at rest.

17. The dampening element of claim 16, wherein said dampening element includes a laterally protruding rib extending convexly from said contact face, wherein said initial contact point is positioned on said rib.

18. The dampening element of claim 16, wherein said contact face is curved at least partially along said width of said contact face, wherein the curve of said contact face is defined by two extending and spaced apart side portions and an inset middle portion.

19. The dampening element of claim 18, wherein said side portions are adapted to flex inward toward each other when said bowstring contacts said middle portion upon its release.

20. The dampening element of claim 17, wherein said rib has a width and is curved at least partially along said width of said rib.

* * * * *